United States Patent [19]

Weers

[11] Patent Number: 4,978,366

[45] Date of Patent: Dec. 18, 1990

[54] DISTILLATE FUELS STABILIZED WITH DIAMINOMETHANE AND METHOD THEREOF

[75] Inventor: Jerry J. Weers, Ballwin, Mo.

[73] Assignee: Petrolite Corporation, St. Louis, Mo.

[21] Appl. No.: 143,782

[22] Filed: Jan. 14, 1988

[51] Int. Cl.[5] ..... C10L 1/22

[52] U.S. Cl. ..... 44/334; 44/333; 44/340; 44/432

[58] Field of Search ..... 44/72, 63

[56] References Cited

U.S. PATENT DOCUMENTS

| | | | |
|---|---|---|---|
| 2,333,294 | 11/1943 | Chenicek | 44/72 |
| 3,364,000 | 1/1968 | Stromberg | 44/69 |
| 3,486,866 | 12/1969 | Stromberg et al. | 44/72 |
| 3,493,354 | 2/1970 | Jones | 44/72 |
| 3,523,769 | 8/1970 | Tocke | 44/72 |
| 3,705,024 | 12/1972 | Zimmerman | 44/72 |
| 3,709,668 | 1/1973 | Zimmerman | 44/72 |
| 3,912,641 | 10/1975 | Wiese | 44/72 |
| 3,969,253 | 7/1976 | Poklacki | 44/72 |
| 4,090,854 | 5/1978 | Davis | 44/73 |
| 4,197,081 | 4/1980 | Osborg | 44/72 |
| 4,244,703 | 1/1981 | Kaspaul | 44/72 |
| 4,417,904 | 11/1983 | Burns | 44/72 |

FOREIGN PATENT DOCUMENTS 2651465 5/1987 Fed. Rep. of Germany .

*Primary Examiner*—Olik Chaudhuri
*Assistant Examiner*—James M. Hunter, Jr.
*Attorney, Agent, or Firm*—Grace J. Fishel; Robert E. Wexler; Stanley M. Tarter

[57] ABSTRACT

A distillate fuel, particularly one which has a high acid number initially or which develops a high acid number as a result of fuel degradation, stabilized with a diaminomethane of the formula:

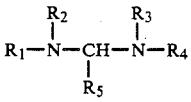

wherein $R_1$, $R_2$, $R_3$ and $R_4$ may be independently a saturated or unsaturated hydrocarbon group, e.g., alkyl, aryl, aralkyl, alkaryl, cycloalkyl, alkenyl, aralkenyl, alkenylaryl, cycloalkenyl and the like or heterocyclyl groups and in which $R_1$ and $R_2$ and/or $R_3$ and $R_4$ may be joined together to form a five or six member heterocyclyl ring and $R_5$ may be hydrogen or lower alkyl is disclosed. A method of stabilizing a fuel oil wherein a stabilizing amount of the above-mentioned diaminomethane is incorporated into the fuel oil is also disclosed.

22 Claims, No Drawings

DISTILLATE FUELS STABILIZED WITH DIAMINOMETHANE AND METHOD THEREOF

BACKGROUND OF THE INVENTION

1. Field of the Invention

This invention relates to a stability additive for distillate fuels.

More particularly, the present invention relates to stabilization of distillate fuels, particularly those which have a high acid number initially or which develop a high acid number as a result of fuel degradation, with a diaminomethane of the formula:

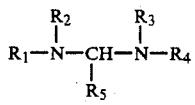

wherein $R_1$, $R_2$, $R_3$ and $R_4$ may be independently a saturated or unsaturated hydrocarbon group, e.g., alkyl, aryl, aralkyl, alkaryl, cycloalkyl, alkenyl, aralkenyl, alkenylaryl, cycloalkenyl and the like or heterocyclyl groups and in which $R_1$ and $R_2$ and/or $R_3$ and $R_4$ may be joined together to form a five or six member heterocyclyl ring and $R_5$ may be hydrogen or lower alkyl.

Accordingly, it is an object of the present invention to provide a distillate fuel which is stabilized with a diaminomethane.

A further object is to provide a method for stabilizing a distillate fuel with a diaminomethane.

Other objects and features of the invention will be in part apparent and in part pointed out hereinafter, the scope of the invention being indicated by the subjoined claims.

2. Prior Art

The condensation products of formaldehyde and a number of primary amines are known to be useful in distillate fuels to increase color stability and resistance to sedimentation. These products have taken the form of a trimeric formaldimine, in the case of normal primary amines, or a monomeric formaldimine, in the case of aliphatic primary amines having a tertiary carbon atom attached to the nitrogen atom thereof.

Secondary amines are also known to react with formaldehyde, in this instance, to form diaminomethanes which have been used as biocides or alkylating agents. Insofar as known, however, diaminomethanes as herein described have not been recognized as useful in stabilizing distillate fuels, in general, or in stabilizing distillate fuels having a high acid number, in particular.

SUMMARY OF THE INVENTION

The present invention is concerned with an additive which is particularly effective at stabilizing distillate fuel having a high acid number initially or developing a high acid number as a result of fuel degradation, said additive being a diaminomethane of the formula:

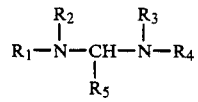

wherein $R_1$, $R_2$, $R_3$ and $R_4$ may be independently a saturated or unsaturated hydrocarbon group, e. g., alkyl, aryl, aralkyl, alkaryl, cycloalkyl, alkenyl, aralkenyl, alkenylaryl, cycloalkenyl and the like or heterocyclyl groups and in which $R_1$ and $R_2$ and/or $R_3$ and $R_4$ may be joined together to form a five or six member heterocyclyl ring and $R_5$ may be hydrogen or lower alkyl.

DETAILED DESCRIPTION OF THE INVENTION

The diaminomethanes which are the subject of the present invention may be obtained by reacting a secondary amine having the formula:

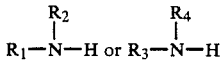

in which $R_1$, $R_2$, $R_3$ and $R_4$ are as defined above with an aldehyde having the formula:

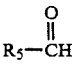

in which $R_5$ is as defined above. The secondary amine and the aldehyde are preferably combined in a ratio of about 2:1, i.e., the stoichiometric amount for the formation of diaminomethane with substantially no side products.

The alkyl or alkenyl portion of the alkyl, aralkyl, alkaryl, alkenyl, aralkenyl and alkenylaryl groups of the $R_1$, $R_2$, $R_3$ and $R_4$ groups contains about 1 to 6 carbon atoms, straight or branched chain, so long as the product diaminomethane is soluble in middle distillate fuels and preferably is insoluble or only slightly soluble in water such that it is not extracted from the fuel. For treatment efficiency, it is preferred that $R_1$, $R_2$, $R_3$ and $R_4$ contain from 3 to 5 carbon atoms, most preferably 4 carbon atoms, since below about 4 there is a tendency for the diaminomethane to be soluble in water. When $R_1$ and $R_2$ and/or $R_3$ and $R_4$ are joined to form a five or six member heterocyclyl ring, the ring may include other heterocyclic atoms such as N, O or S in addition to the nitrogen to which $R_1$ and $R_2$ or $R_3$ and $R_4$ are joined. The ring may also be unsaturated. Examples of secondary amines from which diaminomethanes as described herein may be formed include di-N-butylamine, N-ethyl cyclohexylamine, dicyclohexylamine, morpholine, 2,6-dimethyl morpholine, 2,6-dimethyl piperidine, pyrrole or the like.

When $R_5$ is lower alkyl as opposed to hydrogen, it becomes increasingly difficult with increasing chain length to prevent the formation of the enamine. For example when $R_5$ is methyl, the diaminomethylmethane product is stable at temperatures below about 70 degrees F. but above about 80 degrees F. it undergoes elimination and the enamine is formed. For alkyl groups higher than methyl, elimination occurs at even lower temperatures and therefore it is preferred that $R_5$ contain no more than about 3 carbon atoms.

The diaminomethanes useful in the subject invention may be prepared under conventional dehydrating conditions whereby water is removed by any suitable means. Typically, the aldehyde is added to the secondary amine and the condensate recovered by mechanically separating as much of the water of reaction as possible and distilling off the balance. The reaction is exothermic and the exotherm should be controlled particularly when the aldehyde is other than formaldehyde to prevent formation of the enamine. The subject diaminomethanes may be formed from mixtures of different aldehydes and/or mixtures of different secondary amines and mixtures of different diaminomethanes may be used as fuel stabilizers in accordance with the present invention. The reaction may be conducted neat or in a solvent such as ether, benzene, alcohol, hexane, xylene and the like, in which case the solvent may be distilled off with the water. Solvents with lower boiling points are preferred since the diaminomethanes, particularly those where $R_5$ is other than hydrogen, as mentioned above, tend to decompose at higher temperatures.

Fuel oils make up those hydrocarbon fractions obtained in the distillation of crude oil having an initial boiling point of at least 100 degrees F. and an end point not higher than about 750 degrees F. at atmospheric or reduced pressure, boiling substantially continuously throughout their distillation range. As such, they can be straight-run distillates, catalytically or thermally cracked distillates (including hydrocracked distillates), or mixtures of straight-run distillates, naphthas and the like, with cracked distillates so long as they meet A.S.T.M. specifications. The distillation range of each individual fuel oil covers a relatively narrow range falling, nevertheless, within the above-specified limits. Fuel oils are also characterized by their relative low viscosities, low pour points, and the like but the principal property which characterizes them is their distillation range.

The acid number of a fuel oil is determined by its chemical composition and is high if it requires 0.1 mg KOH/g fuel or more as determined by A.S.T.M. Specification D664. Straight run distillates from naphthenic and aromatic crudes have a high acid number as they are distilled, ranging up to 2 or 3 mg KOH/g fuel for some naphthenic crudes from the West Coast of the United States. If left untreated, fuel oils with an initial high acid number are unstable with attendant development of color and sedimentation. Straight-run distillates from paraffinic crudes, on the other hand, do not have a high acid number and are usually stable.

Cracked distillate stocks, irrespective of the nature of the crude oil from which they are made, contain some olefins which are formed by dehydrogenation of paraffins and naphthenes as they are processed through the cracking towers. Cracked distillate stocks do not usually have a high acid number initially but if they contain a large amount of olefins oxidize and develop a high acid number in time with attendant development of color and sedimentation. Cracked distillate stocks, e.g. catalytically cracked stocks such as light cycle oil or thermally cracked stocks such as coker distillates, are sometimes used as such for fuel or for other purposes but very frequently they are blended with straight-run stocks to increase the fuel pool. If the blended fuel contains cracked stocks with a large amount of olefins, it will also develop a high acid number in time with attendant development of color and sedimentation.

Fuel oils which are particularly improved in accordance with the present invention have a high acid number initially or, if left untreated, develop a high acid number due to oxidative degradation. Especially contemplated herein are Nos. 1, 2, 3, 4 and 6 fuel oils used in domestic heating and as diesel fuel oils, particularly those made up chiefly or entirely of distillate or cracked stocks from naphthenic crudes. The domestic heating oils generally conform to A.S.T.M. Specifications D396-86 and the diesel fuel oils are defined in A.S.T.M. Specifications D975-81. In the case of Nos. 1, 2 and 3 fuel oils, the diaminomethanes as described herein are added primarily to improve color stability of the fuel, whereas in Nos. 4 and 6 fuel oils, the diaminomethane additives are added primarily as sweeteners or to retard sedimentation and thus are added in an amount effective to sweeten and/or retard sedimentation of the fuel oil.

The amount of the diaminomethane as herein defined effective to stabilize fuel oils will vary, depending on various factors, for example the particular oil to be stabilized and the conditions for storage. The stability of an oil depends largely on the nature of the crude oil from which it is made and the type of processing involved during refining and therefore some oils will require more additive to stabilize than others. In practice, at least about 0.0001% (1 ppm) additive based on the weight of the oil is used, such as from about 0.0001 to 0.1% (1–1000 ppm), for example from about 0.0002 to 0.05% (2–500 ppm), but preferably from about 0.0003 to 0.03% (3–300 ppm). Larger amounts, such as 1% or higher, can be employed but in general there is usually no commercial advantage in doing so.

In accordance with common practice, the diaminomethanes as herein defined may be used in combination with other stabilizers. For example with fuel oils from naphthenic crudes, it is usually necessary to utilize the subject diaminomethanes with other stabilizers which are effective as dispersants. Metal deactivators may also be included for some applications. In most instances, however, it is not necessary to add sweeteners as the subject diaminomethanes scavenge hydrogen sulfide and mercaptans in addition to serving as color stabilizers and/or dispersants for the fuel oil. Suitable dispersants for use in combination with the diaminomethanes as herein described include Mannich condensates of alkylphenols, formaldehyde and polyamines, although other dispersants may also be used.

The following examples illustrate the invention.

EXAMPLE 1

4, 4'-Methylene bis-(morpholine) (Additive I) was prepared in a quantitative yield by reacting morpholine and formaldehyde as follows: In a round bottom flask fitted with a Dean Stark trap, 0.1 mole of formaldehyde was added dropwise with stirring to 0.2 mole of morpholine. The temperature in the reaction mixture slowly rose to 60 degrees C. during the addition. After the formaldehyde addition was complete, the reaction mixture was stirred at 70 degrees C. for one hour and the water of reaction mechanically separated. Under a vacuum (100 mm Hg), the temperature was then increased to distill off any remaining water entrained in the reaction mixture. Heating was continued until the temperature of the mixture reached 135 degrees C. and the material was then cooled.

EXAMPLE 2

Throughout the following examples color stability was determined by A.S.T.M. Specification D-1500 and %T (light transmittance) was measured at 530 nm. The amount of solids was determined after storage under the indicated conditions by passing the exposed fuel through a moderately retentive Whatman 1 filter paper and noting the degree of stain on the filter paper. The filter paper pads were compared according to a rating of 1=best and 20=worst. In some instances, the amount of solids was determined by measuring the amount of filterable residue on the pad. The hydrogen sulfide or mercaptan content of the distillate fuel was determined by A.S.T.M. Specification 3227.

The 2:1 molar condensate of morpholine and formaldehyde (Additive I) was tested for its effect on color stability and resistance to sedimentation in a diesel oil from a West Coast crude having an initial acid number of 1.54 mg KOH/g fuel which rose to 1.60 mg KOH/g fuel in the untreated oil at the end of 10 days ambient storage. The indicated amount of an alkylphenol, formaldehyde and polyamine condensate was included as a dispersant in some instances. The results were as follows under several test conditions:

| Additive | Conc (ppm) | D-1500 Color | % T |
|---|---|---|---|
| Test Method: 10 days ambient storage | | | |
| Blank | — | 4.0 | 27 |
| Additive I + Dispersant | 1000 | 2.0 | 47 |
| Additive I + Dispersant | 667 + 333 | 2.5 | 52 |
| Test Method: 10 days storage at 110 degrees F. | | | |
| Blank | — | 5.0 | 15 |
| Additive I + Dispersant | 1000 | <3.0 | 46 |
| Additive I + Dispersant | 667 + 333 | 3.0 | 40 |

| Additive | Conc (ppm) | D-1500 Color | Residue Pad Rating |
|---|---|---|---|
| Test Method: 90 minutes storage at 300 degrees F. | | | |
| Blank | — | 7.0 | 15 |
| Additive I + Dispersant | 1000 | 5.0 | 8 |
| Additive I + Dispersant | 667 + 333 | 3.5 | 1 |

EXAMPLE 3

The 2:1 molar condensate of morpholine and formaldehyde (Additive I) was tested for its effect on color stability and resistance to sedimentation in diesel oil from a paraffinic crude to which 2000 ppm of thiophenol had been added. The diesel oil had an initial acid number of 0.04 mg KOH/g fuel which was virtually unchanged (0.60 mg KOH/g fuel) in the untreated fuel at the end of the test. The indicated amount of an alkylphenol, formaldehyde and polyamine condensate was included as a dispersant in some instances. The results were as follows:

| Additive | Conc (lb/mbbl) | D-1500 Color | Residue Pad Rating |
|---|---|---|---|
| Test Method: 90 minutes storage at 300 degrees F. | | | |
| Blank | — | 8.0 | 14 |
| Additive I + Dispersant | 50 | 5.0 | 7 |
| Additive I + Dispersant | 33.3 + 16.7 | 3.0 | 3 |

EXAMPLE 4

The 2:1 molar condensate of morpholine and formaldehyde (Additive I) and the 2:1 molar condensate of di-n-butyl amine and formaldehyde (Additive II) were tested for its effect on color stability and resistance to sedimentation in diesel oil from a West Coast crude having an initial acid number of 1.32 mg KOH/g fuel which rose to 1.50 mg KOH/g fuel in the untreated fuel at the end of 2 weeks storage at 110 degrees F. The indicated amount of an alkylphenol, formaldehyde and polyamine condensate was included as a dispersant in some instances. The results were as follows:

| Additive | Conc (ppm) | D-1500 Color | % T | Pad Rating |
|---|---|---|---|---|
| Test Method: 90 minutes storage at 300 degrees F. | | | | |
| Blank | — | 5.5 | 5 | 17 |
| Additive I | 50 | 3.5 | 19 | 10 |
| | 100 | 3.5 | 19 | 11 |
| | 300 | 3.5 | 23 | 8 |
| Dispersant + Additive II | 30 + 20 | 5.5 | 6 | 15 |
| | 60 + 40 | 5.5 | 6 | 17 |
| | 180 + 120 | 5.0 | 10 | 11 |
| | 16.7 + 33.3 | 5.0 | 10 | 15 |

| Additive | Conc (ppm) | D-1500 Color | % T |
|---|---|---|---|
| Test Method: 2 weeks storage at 110 degrees F. | | | |
| Blank | — | 3.5 | 18 |
| Additive I | 50 | <3.0 | 38 |
| | 100 | <3.0 | 40 |
| | 300 | <2.5 | 57 |
| Dispersant + Additive II | 30 + 20 | 3.5 | 22 |
| | 60 + 40 | 3.5 | 22 |
| | 180 + 120 | 3.5 | 24 |
| | 16.7 + 33.3 | 3.0 | 28 |

| Additive | Conc (ppm) | D-1500 Color | % T | Filterable Residue mg/100 mL |
|---|---|---|---|---|
| Test Method: 5 weeks storage at 110 degrees F. | | | | |
| Blank | — | 4.0 | 12 | 0.3 |
| Additive I | 50 | <3.5 | 25 | 0.3 |
| | 100 | <3.5 | 24 | 0.3 |
| | 300 | 3.0 | 35 | 0.3 |
| Dispersant + Additive II | 30 + 20 | 4.0 | 11 | 0.2 |
| | 60 + 40 | 4.0 | 13 | 0.2 |
| | 180 + 120 | 4.0 | 14 | 0.3 |
| | 16.7 + 33.3 | 3.5 | 20 | — |

EXAMPLE 5

The 2:1 molar condensate of 2,6-dimethylpiperidine and formaldehyde (Additive III) and the 2:1 molar condensate of N-ethyl cyclohexylamine and formaldehyde (Additive IV) were tested for their effect on color stability and resistance to sedimentation in a diesel oil from a West Coast crude having an initial acid number of 1.92 mg KOH/g fuel which remained unchanged in the untreated sample to the end of the 20 days ambient storage test. The results were as follows:

| Additive | Conc (lb/mbbl) | D-1500 Color |
|---|---|---|
| Test Method: 7 days ambient storage | | |
| Blank | — | <3.5 |
| Additive III | 100 | <3.5 |
| | 500 | <2.5 |
| Additive IV | 100 | <3.5 |
| | 500 | <3.0 |

| Additive | Conc (lb/mbbl) | D-1500 Color | % T |
|---|---|---|---|
| Test Method: 20 days ambient storage | | | |
| Blank | — | <4.0 | 27 |
| Additive III | 100 | <4.0 | — |
| | 500 | 3.0 | 44 |
| Additive IV | 100 | <4.0 | — |
| | 500 | 3.0 | 41 |

EXAMPLE 6

The 2:1 molar condensate of morpholine and formaldehyde (Additive I) and the 2:1 condensate of di-n-butyl amine and formaldehyde (Additive II) was tested as a sweetener for a sour naphtha. The results were as follows:

| Additive | Test Method: 3 days at ambient temperature Conc(ppm) | Conc S(ppm) |
|---|---|---|
| Blank | — | 1352.5 |
| Additive I | 1500.0 | 1196.0 |
| | 3000.0 | 395.4 |
| Additive II | 1500.0 | 972.5 |
| | 3000.0 | 332.3 |

EXAMPLE 7

Additives I and II were also tested as a sweetener for a diesel fuel to which thiophenol had been added. The results were as follows:

| Additive | Test Method: 3 days at ambient temperature Conc(ppm) | Conc S(ppm) |
|---|---|---|
| Blank | — | 620.1 |
| Additive I | 1000.0 | 197.8 |
| | 3000.0 | 170.5 |
| Additive II | 1000.0 | 394.8 |
| | 3000.0 | 266.9 |

In view of the above, it will be seen that the several objects of the invention are achieved and other advantageous results attained. As various changes could be made in the above described methods and products without departing from the scope of the invention, it is intended that all matter contained in the above description shall be interpreted as illustrative and not in a limiting sense.

We claim:

1. A fuel oil comprising a distillate fuel oil having incorporated therein a diaminomethane of the formula

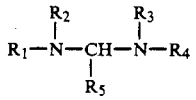

wherein $R_1$, $R_2$, $R_3$ and $R_4$ are independently selected from the group consisting of alkyl, cycloalkyl, alkenyl, cycloalkenyl and five or six member heterocyclic groups wherein $R_1$ with $R_2$ or both $R_1$ and $R_2$ and $R_3$ with $R_4$ are alkylene groups joined together with their adjacent N to form a heterocyclic ring and wherein $R_5$ is a member selected from the group consisting of hydrogen and lower alkyl in an mount effective to increase color stability or resistance to sedimentation of said fuel oil.

2. A distillate fuel oil of claim 1 wherein $R_1$, $R_2$, $R_3$ and $R_4$ are alkyl or alkenyl groups containing from about 3 to 5 carbon atoms.

3. The distillate fuel oil of claim 1 wherein $R_1$ with $R_2$ or both $R_1$ with $R_2$ and $R_3$ with $R_4$ are ethylene groups joined to form a heterocyclic structure including a hetero atom selected from the group consisting of N, O, and S in addition to the N in which $R_1$ with $R_2$ or both $R_1$ with $R_2$ and $R_3$ with $R_4$ are joined.

4. The distillate fuel oil of claim 1 wherein diaminomethanes are present as a mixture.

5. The distillate fuel oil of claim 1 wherein $R_5$ is hydrogen.

6. The distillate fuel oil of claim 1 wherein the fuel oil is a No. 1, 2 or 3 fuel oil.

7. The distillate fuel oil of claim 1 wherein the fuel is a No. 4 or 6 fuel oil.

8. A distillate fuel oil of claim 1 wherein the diaminomethane is the condensate of formaldehyde and morpholine.

9. A distillate fuel oil of claim 1 wherein the diaminomethane is the condensate of formaldehyde and di-n-butylamine.

10. A distillate fuel oil of claim 1 wherein the diaminomethane is the condensate of formaldehyde and 2,6-dimethylpiperidine.

11. A distillate fuel oil of claim 1 wherein the diaminomethane is the condensate of formaldehyde and N-ethylcyclohexylamine.

12. A method of treating a distillate fuel oil which comprises incorporating therein a diaminomethane of the formula

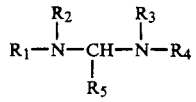

wherein $R_1$, $R_2$, $R_3$ and $R_4$ are independently selected from the group consisting of alkyl, cycloalkyl, alkenyl, cycloalkenyl and five or six member heterocyclic groups wherein $R_1$ with $R_2$ or both $R_1$ with $R_2$ and $R_3$ with $R_4$ are alkylene groups joined together with their adjacent N to form a heterocyclic ring and wherein $R_5$ is a member selected from the group consisting of hydrogen and lower alkyl in an amount effective to increase color stability or resistance to sedimentation of said fuel.

13. The method of claim 12 wherein $R_1$, $R_2$, $R_3$ and $R_4$ are alky or alkenyl groups consisting from about 3 to 5 carbon atoms.

14. The method of claim 12 wherein $R_1$ with $R_2$ or both $R_1$ with $R_2$ and $R_3$ with $R_4$ are ethylene groups joined to form a heterocyclic structure including a hetero atom selected from the group consisting of N, O, and S in addition to the N to which $R_1$ and $R_2$ or both $R_1$ and $R_2$ and $R_3$ and $R_4$ are joined.

15. The method of claim 12 wherein diaminomethanes are present as a mixture.

16. The method of claim 12 wherein $R_5$ is hydrogen.

17. The method of claim 12 wherein the fuel oil is a No. 1, 2 or 3 fuel oil.

18. The method of claim 12 wherein the fuel oil is a No. 4 or 6 fuel oil.

19. The method of claim 12 wherein the diaminomethane is the condensate of formaldehyde and morpholine.

20. The method of claim 12 wherein the diaminomethane is the condensate of formaldehyde and di-n-butylamine.

21. The method of claim 12 wherein the diaminomethane is the condensate of formaldehyde and 2,6-dimethylpiperidine.

22. The method of claim 12 wherein the diaminomethane is the condensate of formaldehyde and N-ethylcyclohexylamine.

* * * * *